US008091671B1

(12) United States Patent
Horsey et al.

(10) Patent No.: US 8,091,671 B1
(45) Date of Patent: Jan. 10, 2012

(54) POWERED SNOWBOARD

(76) Inventors: Michael Randolph Horsey, Pagosa Springs, CO (US); Janet Lynn Hollarbush, Pagosa Springs, CO (US)

( * ) Notice: Subject to any disclaimer, the term of this patent is extended or adjusted under 35 U.S.C. 154(b) by 297 days.

(21) Appl. No.: 12/619,449

(22) Filed: Nov. 16, 2009

Related U.S. Application Data

(60) Provisional application No. 61/143,410, filed on Jan. 8, 2009.

(51) Int. Cl.
*A63C 5/08* (2006.01)

(52) U.S. Cl. ..... 180/181; 180/180

(58) Field of Classification Search ..... 180/180, 180/181, 182, 186, 190, 191; 440/53, 55, 440/61 R, 61 T
See application file for complete search history.

(56) References Cited

U.S. PATENT DOCUMENTS 1,831,739 A * 11/1931 Decker ..... 440/63
3,498,253 A * 3/1970 Wood, Jr. ..... 440/6
3,645,348 A * 2/1972 Thompson ..... 180/181
3,750,777 A * 8/1973 Thompson ..... 180/180
5,662,186 A * 9/1997 Welch ..... 180/181
5,975,229 A * 11/1999 Hosoda ..... 180/181
6,193,003 B1 * 2/2001 Dempster ..... 180/180
6,725,959 B1 * 4/2004 Shea et al. ..... 180/190
7,434,644 B2 * 10/2008 Wier ..... 180/180
2004/0154849 A1 * 8/2004 Fodor ..... 180/181
2004/0163868 A1 * 8/2004 Decker, Jr. ..... 180/181
2007/0205034 A1 * 9/2007 Wier ..... 180/181
2008/0169147 A1 7/2008 Brazier

* cited by examiner

*Primary Examiner* — J. Allen Shriver, II
*Assistant Examiner* — Emma K Frick
(74) *Attorney, Agent, or Firm* — Patent Law Offices of Rick Martin, P.C.

(57) ABSTRACT

A snowboard has a removable tripod at the rear. A tiller mounts atop the tripod. The rider end of the tiller supports a motor. The distal end of the tiller supports a powered wheel. The power assembly doesn't compromise the shape and dynamics of a traditional snowboard as much of the prior art has. Another advantage is that it can be made integral with the snowboard and also easily removed. The ease of control with the handle and radical turning ability of over 180° make it unique in this field. The tripod mounting and balancing are also unique and useful. It is lighter in weight and simpler than previous embodiments in this are. The tiller can be locked with the wheel up for freestyle snowboarding.

17 Claims, 4 Drawing Sheets

POWERED SNOWBOARD

CROSS REFERENCE APPLICATIONS

This application is a non-provisional application claiming the benefits of provisional application No. 61/143,410 filed Jan. 8, 2009.

FIELD OF INVENTION

The present invention relates to a detachable motorized ribbed wheel propulsion assembly for a snowboard.

BACKGROUND OF THE INVENTION

The closest known prior art is U.S. Pat. No. 6,725,959 (2004) to Shea et al. A snowboard is fitted at the rear with a mounting assembly to support a motor. The motor powers a flexible track with a tread. A tiller moves the motor and track side to side for steering. The motor and tread are set at snow level and cannot be lifted up to allow natural snowboarding.

What is needed in the art is a powered snowboard that can be put into a passive mode to allow natural snowboarding downhill. The present invention provides this passive mode by mounting the tiller near its center on a tripod. The motor acts as a counterweight to the motorized tread which is mounted behind the snowboard. Thus, by locking the motor in a down position, the tread is supported in the air above the snow. Now the rider can ski downhill with his hands free.

SUMMARY OF THE INVENTION

This invention comprises a unique way to propel a snowboarder and snowboard across the snow. It is a device that can easily be put on and taken off a traditional snowboard. The powered device rotates a ribbed wheel in back of the snowboard which propels the snowboard forward. The snowboarder controls this propulsion with a handle with a finger activated throttle. The snowboarder can lift the handle up and down for engaging and disengaging the drive wheel with the snow. He can also move the handle horizontally to rotate the drive wheel around the rear end of the snowboard more than 180°, thus enabling the snowboarder to push the rear end forward, left or right, or any combination of these. Propelling the snowboard, turning left or right, engaging and disengaging the drive wheel with the snow are all done with one hand and arm. It is noted that the snowboarder can steer the snowboard by the traditional, non-powered method of balance control and by the control that this powered device gives him so he can use them in combination or alone.

One of the key elements of this invention is the tripod on which this drive system rests. It balances the weight of the drive wheel and engine making it easy to handle and allows easy movement on both vertical and horizontal axes. This tripod is affixed to the snowboard in three places and held by pins so the whole power unit can be quickly released to use the snowboard alone. The tripod is adjustable up and down and forward and backward for the snowboarder's comfort and accessibility to the control handle.

Other aspects of this invention will appear from the following description and appended claims, reference being made to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Figure 1:
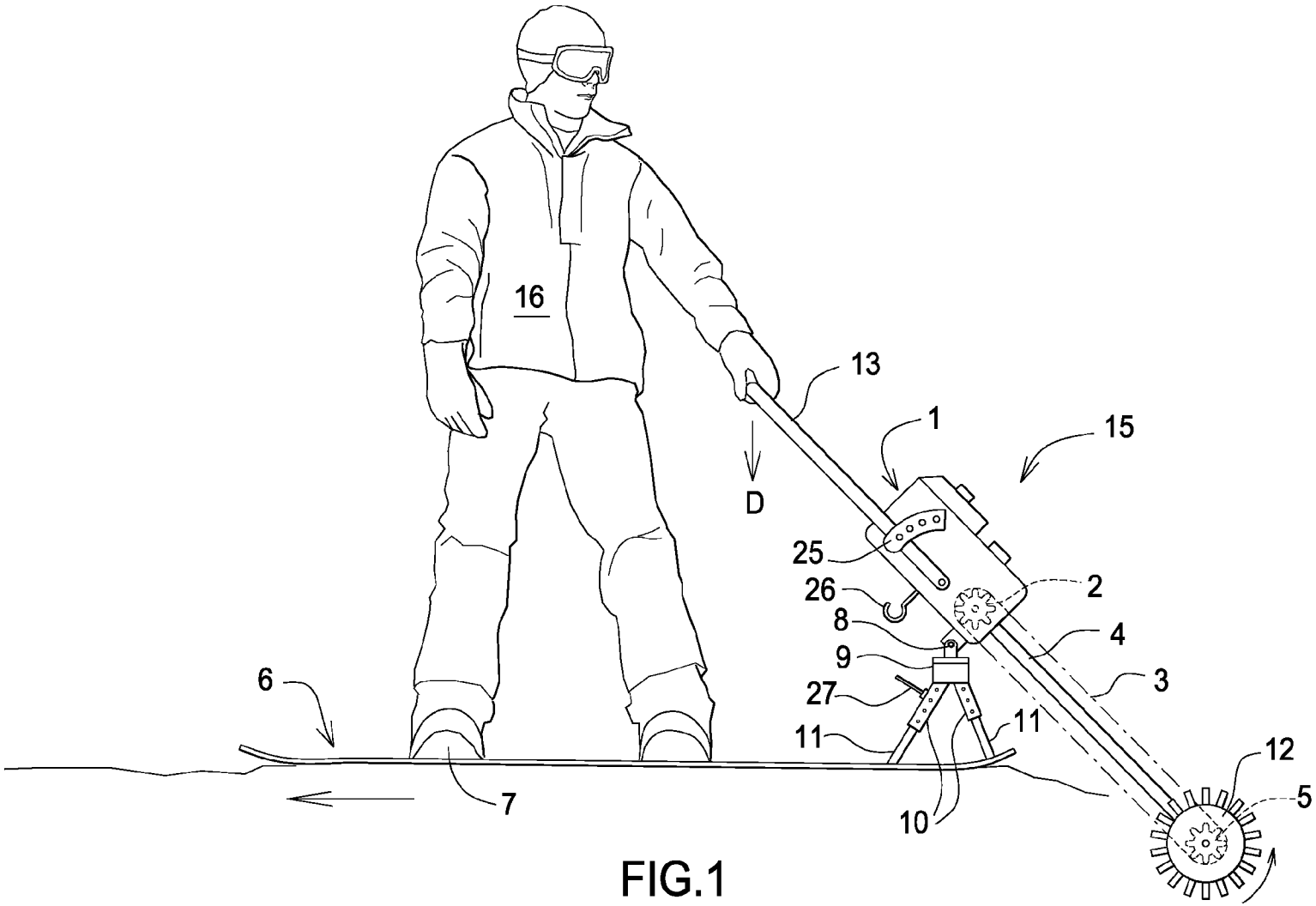
FIG. 1 is a right side elevation view of the present invention and snowboarder.
Figure 2:
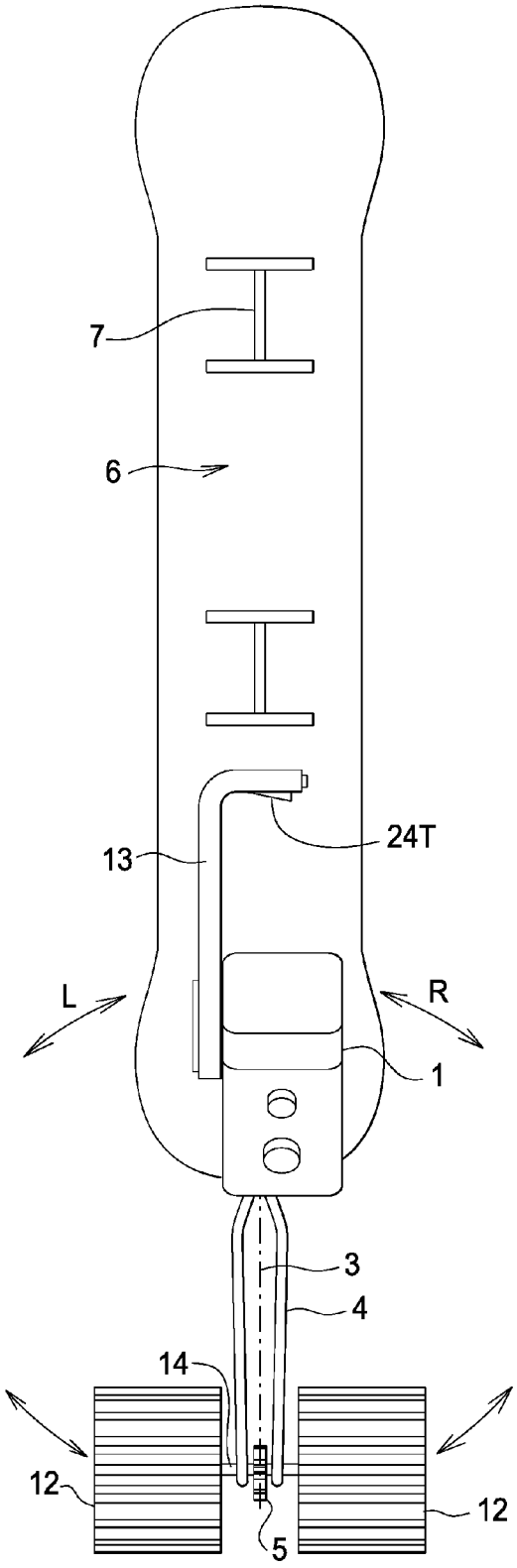
FIG. 2 is a top plan view of the present invention.
Figure 3:
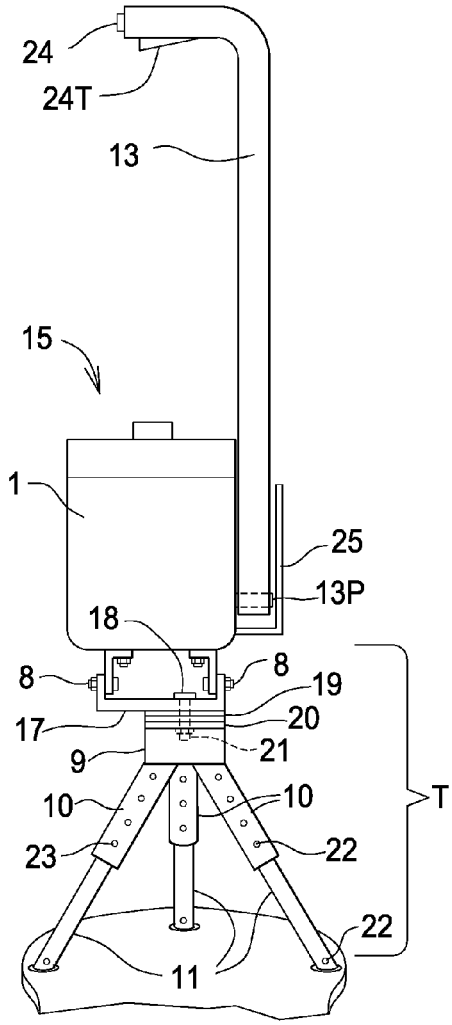
FIG. 3 is a front perspective view of the tripod and frame of an embodiment of the present invention.
Figure 4:
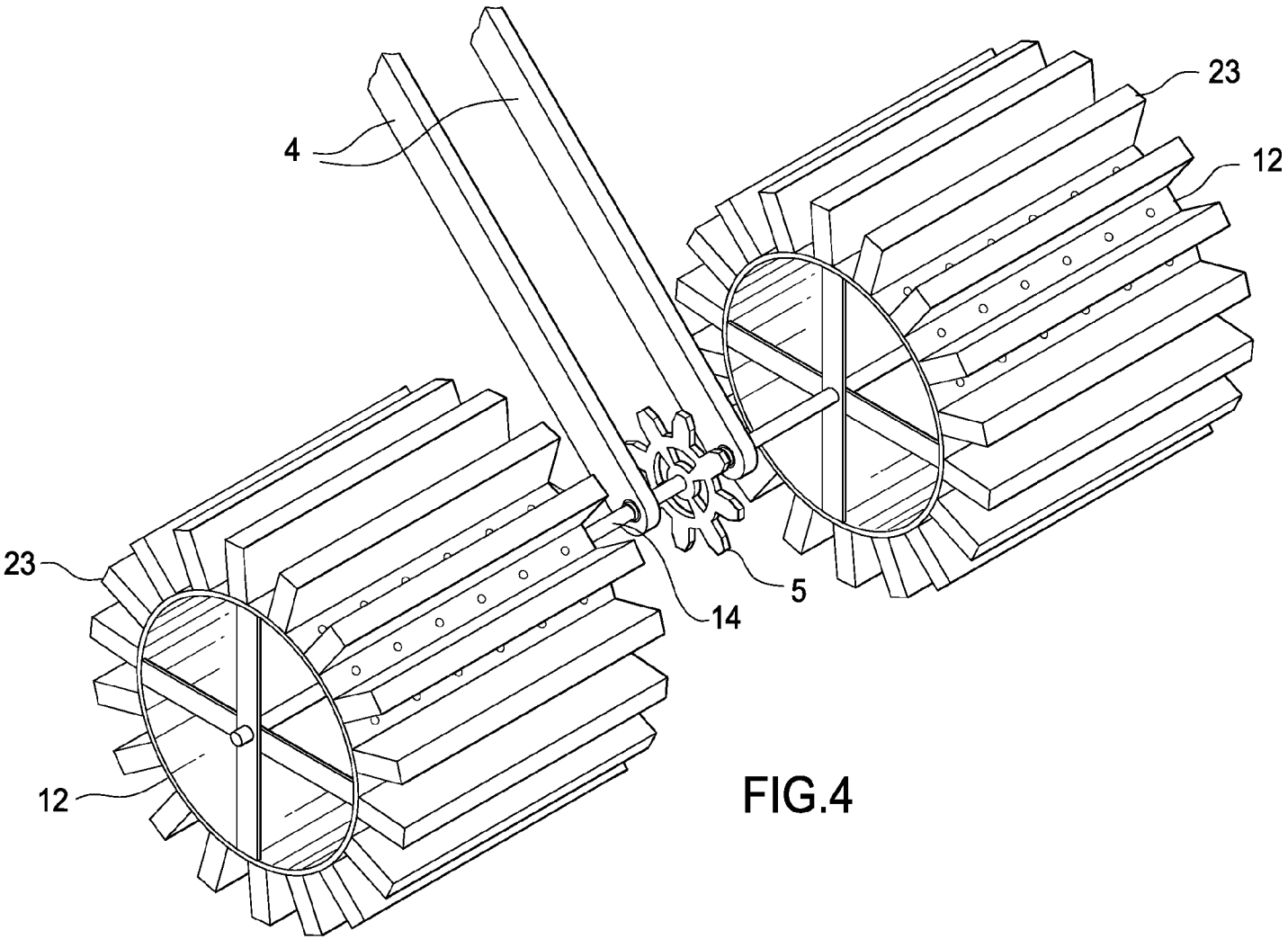
FIG. 4 is a top perspective view of the drive wheel assembly of an embodiment of the present invention.

Referring to FIGS. 1 and 2, a standard snowboard 6 has mounted on it the present invention designated generally by the number 15. The snowboard has a pair of standard bindings 7 for the snowboarder 16. The snowboarder operates the invention by using a breakaway handle 13 with a finger-actived throttle control and button lock 24 which is thumb activated (FIG. 3). When the thumb presses in the button 24 it locks by activating a pin in the receiver 25 in various positions to accommodate the operator's preferences. When the thumb doesn't press in button 24 the handle 13 is in breakaway mode and can be moved for safety reasons out of the way. When the handle is locked in position by pressing in thumb button 24 the operator can engage the throttle 24T and move the handle up and down to engage and disengage with the snow as well as moving the handle horizontally left or right to turn the snowboard. The invention includes the aforementioned handle 13, the engine 1 and a drive wheel 12 which propels the snowboard across the snow. The engine 1 and drive wheel 12 are connected by a tubular frame 4 and drive chain or belt 3. The engine 1 is attached to the snowboard 6 by the tripod system T detailed in FIG. 3. The engine 1 is connected to the tripod system T at numeral 8 which also is the vertical pivot point to move the engine 1 up and down as well as the drive wheel 12. This fulcrum and pivot point 8 is at the ends of the U shaped member 17 which connects to the tripod top 9.

A bolt 18 runs through the bottom of the U shaped member 17 and penetrates the tripod top 9 and rests on a slip washer 19 so as to form a horizontal swivel for the engine 1, drive wheel 12 and connecting frame 4 to control the direction of movement of the snowboard. A slip washer 20 located under the tripod top held by a nut and cotter pin 21 attaches the U shaped member 17 to the tripod and also allows it to swivel on the horizontal axis. The tripod top 9 is attached to the three adjustable tripod legs 10 by cotter pins 22. These tripod legs 10 can be adjusted up and down via holes 23 which would move the Top 9 up and down as well as forward and backward to suit the snowboarder. The tripod legs 10 attaches to permanent mounts in the snowboard 11 and are affixed by cotter pins 22 for fast and easy removal of the whole tripod T from the snowboard.

The engine 1 rotates a sprocket 2 which propels the chain 3 which turns the rear sprocket 5 which is attached to the drive axel 14 which passes through two bearing points at the ends of the frame 4 and further attaches to the drive wheels 12. When the rear sprocket 5 rotates, the attached drive axle rotates causing the drive wheels 12 to rotate. When the rotating wheels 12 will be made of aluminum or together light weight material and treads 23 of rubber attached thereto will cause traction when rotated in the snow.

Figure 5:
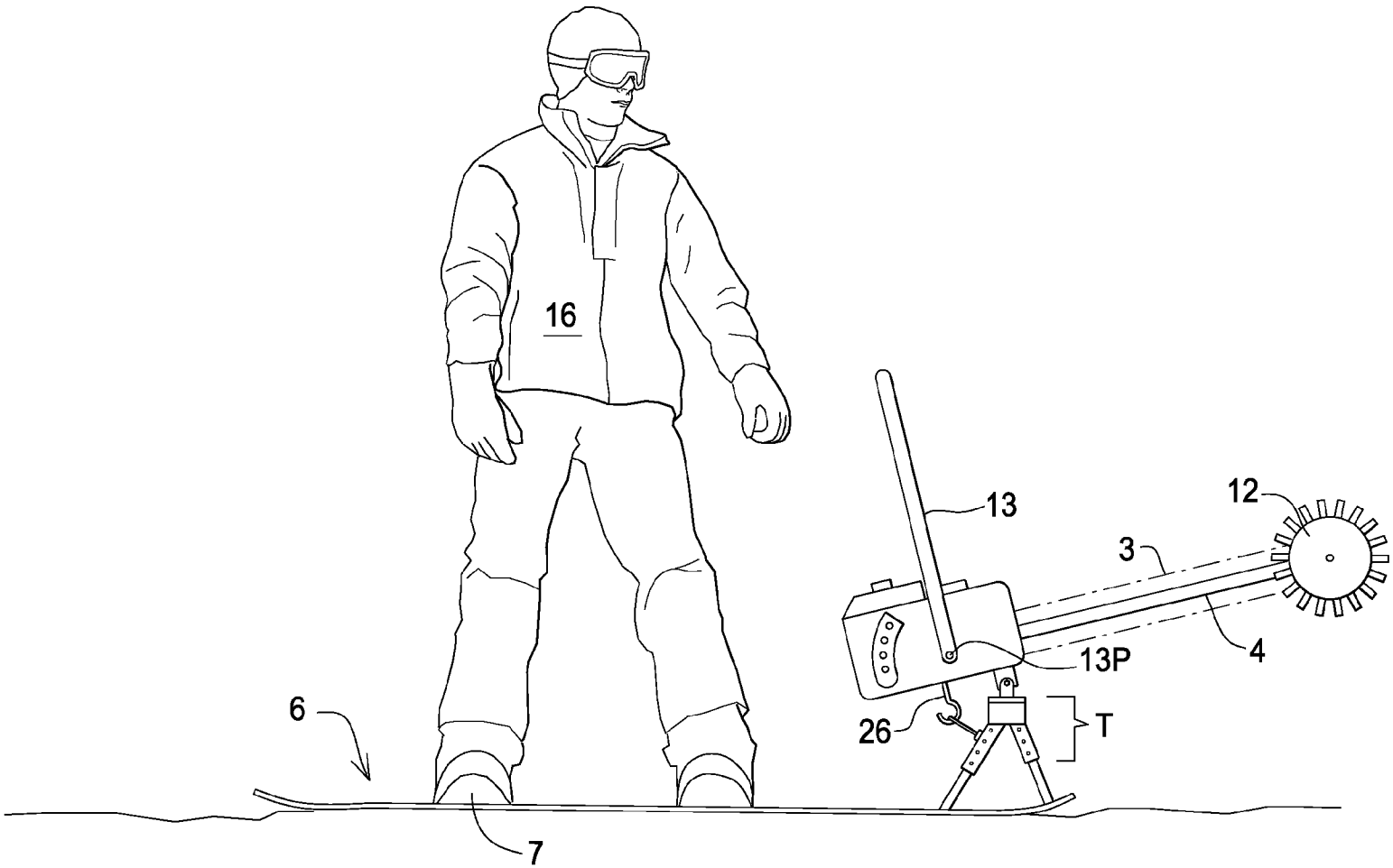
FIG. 5 is a right side elevation view of downhill gliding with the drive mechanism locked down and handle folded out of the way.

On downhill slopes shown in FIG. 5 the operator can lock the dive wheels 12 out of the snow at his discretion by engaging together hooks 26 and 27 which holds the motor 1 in a fixed position. The operator can glide downhill with both hands free steering the snowboard in the traditional manner. For safety he can move the handle 13 out of the way using pivot 13P.

The snowboarder 16 starts the engine 1, puts his boots in the bindings 7 and grabs the handle 13 putting his finger on the throttle 24T and thumb pressing in button 24 to lock the handle 13 in place of his choosing in the receiver 25, he accelerates the throttle causing the centrifugal clutch in the motor 1 engage the chain 3 and drive wheels 12. He lowers the drive wheels 12 into the snow and propels himself and the snowboard 6 forward. By moving the handle 13 to the left L, the snowboard will tune right R and by moving it right R the snowboard 6 will turn left. When the snowboarder 16 pushes down D on the handle 13, the drive wheel 12 will disengage from contact with the snow, and he will glide or come to a stop. The snowboarder 16 will use any combination of maneuvers to operate the snowboard 6 and invention 15. He can go uphill, downhill or on flat terrain. He can use the powered invention to go uphill and then glide downhill without the use of the invention 15. He can turn using traditional snowboard skills or with the powered invention or using a combination of the two. The handle 13 will be a third balance point for the snowboarder 16. It can be set up so the invention 15 can be locked in a position with the drive wheel out of the snow (FIG. 5) and can't swing back and forth so the snowboarder can take his hand off the handle for balance going freestyle downhill.

Although the present invention has been described with reference to preferred embodiments, numerous modifications and variations can be made and still the result will come within the scope of the invention. No limitation with respect to the specific embodiments disclosed herein is intended or should be inferred. Each apparatus embodiment described herein has numerous equivalents.

We claim:

1. A propulsion assembly for a snowboard, said propulsion assembly comprising:

an anchor affixed to a rear end of a snowboard;

a tripod stand removably attached to the anchor; said tripod stand having a top with a swivel mount supported above the rear end of the snowboard;

a tiller assembly affixed to the swivel mount; said tiller assembly comprising a handle facing forward and supporting a motor and comprising a shaft facing rearward supporting a powered wheel and comprising a linkage from the motor to the powered wheel; and wherein pushing the handle down raises the wheel above a surface level and pushing the handle up lowers the wheel into the surface level, thereby propelling the snowboard.

2. The apparatus of claim 1, wherein the swivel mount further comprises a left and right rotational motion enabling the handle to move left and right which moves the powered wheel in an opposite direction of the handle, thereby providing a steering action for the snowboard.

3. The apparatus of claim 1, wherein the tiller assembly further comprises a lock means functioning to lock the motor down and wheel up.

4. The apparatus of claim 3, wherein the handle further comprises a pivot means functioning to fold the handle up out of the way.

5. The apparatus of claim 2, wherein the tiller assembly further comprises a lock means functioning to lock the motor down and wheel up.

6. The apparatus of claim 1, wherein the wheel further comprises treads.

7. The apparatus of claim 1, wherein the tripod stand further comprises adjustable length legs.

8. The apparatus of claim 1, wherein the handle further comprises a button safety lock to lock the handle at a desired angle and provide a release of the handle out of the way.

9. The apparatus of claim 1, wherein the motor further comprises a centrifugal clutch and the linkage further comprises a chain.

10. A motorized snowboard comprising: a snowboard having bindings and a rear end;

a tripod stand on the rear end supporting a propulsion assembly;

said propulsion assembly comprising a tiller with a handle and with a swivel mount means to the stand functioning to provide an up/down and left/right movement for the tiller;

the tiller having a motor at its front end connected via linkage to a wheel at its rear end; and a lock means on the stand functioning to lock the motor down and wheel up, thereby enabling a rider to snowboard with his hands free.

11. The apparatus of claim 10, wherein the tripod stand is removable.

12. The apparatus of claim 10, wherein the handle comprises a fold up pivot point.

13. The apparatus of claim 10, wherein the wheel further comprises an axle to receive the linkage and left and a right portion, each portion having treads.

14. A detachable propulsion assembly for a snowboard, the detachable propulsion assembly comprising:

a removable tripod stand at a rear end of a snowboard;

a tiller having a swivel mount on the tripod stand and a forward handle and a rear shaft;

a motor mounted to the handle and having a linkage to a powered wheel mounted at distal end of the tiller;

wherein moving the handle down raises the wheel up, moving the handle up pushes the wheel down, moving the handle left moves the wheel right, moving the handle right moves the wheel left; and locking the tiller with the wheel up enables a rider to snowboard with his hands free.

15. The apparatus of claim 14 wherein the tripod stand is removable and comprises adjustable length legs.

16. The apparatus of claim 14, wherein the handle further comprises an engagement switch to adjust angle of the tiller relative to the motor.

17. The apparatus of claim 14, wherein the motor further comprises a centrifugal clutch, and the linkage further comprises a chain connected to an axle on the wheel, and the wheel has a left and a right segment, each segment having treads.

* * * * *